US007692598B1

(12) United States Patent
Hibbard et al.

(10) Patent No.: US 7,692,598 B1
(45) Date of Patent: Apr. 6, 2010

(54) METHOD AND APPARATUS FOR TRANSMITTING AND RECEIVING TIME-DOMAIN RADAR SIGNALS

(75) Inventors: Mark W. Hibbard, Arlington, VA (US); Roy Fields Cleveland, III, Potomac Falls, VA (US)

(73) Assignee: Niitek, Inc., Sterling, VA (US)

( * ) Notice: Subject to any disclaimer, the term of this patent is extended or adjusted under 35 U.S.C. 154(b) by 379 days.

(21) Appl. No.: 11/260,038

(22) Filed: Oct. 26, 2005

(51) Int. Cl.
*H01Q 9/28* (2006.01)

(52) U.S. Cl. ..... 343/795; 343/700 MS

(58) Field of Classification Search ..... 343/700 MS, 343/795, 702, 793, 802, 801
See application file for complete search history.

(56) References Cited

U.S. PATENT DOCUMENTS

| | | | | |
|---|---|---|---|---|
| 3,639,784 | A | 2/1972 | Kelleher, Jr. | |
| 4,070,673 | A | 1/1978 | Schmidt et al. | |
| 4,438,404 | A | 3/1984 | Philipp | |
| 4,439,765 | A | 3/1984 | Wilmot | |
| 4,581,715 | A | 4/1986 | Hyatt | |
| 4,590,614 | A * | 5/1986 | Erat | 455/270 |
| 4,591,858 | A | 5/1986 | Jacobson | |
| 4,686,655 | A | 8/1987 | Hyatt | |
| 4,715,000 | A | 12/1987 | Premerlani | |
| 4,760,525 | A | 7/1988 | Webb | |
| 4,833,475 | A | 5/1989 | Pease et al. | |
| 5,003,562 | A | 3/1991 | van Driest et al. | |
| 5,053,983 | A | 10/1991 | Hyatt | |
| 5,115,245 | A * | 5/1992 | Wen et al. | 342/175 |
| 5,192,886 | A | 3/1993 | Wetlaufer | |
| 5,243,343 | A | 9/1993 | Moriyasu | |
| 5,351,055 | A | 9/1994 | Fujikawa et al. | |
| 5,386,215 | A * | 1/1995 | Brown | 343/795 |
| 5,420,531 | A | 5/1995 | Wetlaufer | |
| 5,420,589 | A | 5/1995 | Wells et al. | |
| 5,424,735 | A | 6/1995 | Arkas et al. | |
| 5,444,459 | A | 8/1995 | Moriyasu | |
| 5,451,894 | A | 9/1995 | Guo | |
| 5,495,260 | A * | 2/1996 | Couture | 343/795 |
| 5,510,800 | A | 4/1996 | McEwan | |
| 5,523,760 | A | 6/1996 | McEwan | |

(Continued)

FOREIGN PATENT DOCUMENTS

| | | |
|---|---|---|
| CA | 2266222 | 9/1999 |

(Continued)

OTHER PUBLICATIONS

Kim et al., Design and Realization of A Discretely Loaded Resistive Vee Dipole on a Printed Circuit Board, 2003, pp. 818-829, vol. 5089, Proceedings of SPIE.

(Continued)

*Primary Examiner*—HoangAnh T Le
(74) *Attorney, Agent, or Firm*—DLA Piper LLP (US)

(57) ABSTRACT

Time domain radar signals are transmitted and received from vee dipole antennas on circuit boards. The antennas are formed by spaced deposited copper pads and discrete surface mount resistors soldered between the copper pads. The antenna feed-points are connected directly to adjacent transmitting and receiving circuits on the same printed circuit board. Traces are printed on a middle layer of a strip of printed circuit board. Vias connect ground planes on opposite sides. Artifacts are reduced, and signal properties are controlled.

17 Claims, 3 Drawing Sheets

U.S. PATENT DOCUMENTS 5,552,793 A 9/1996 McLeod et al.
5,661,490 A 8/1997 McEwan
5,748,153 A 5/1998 McKinzie, III et al.
5,805,110 A 9/1998 McEwan
5,900,761 A 5/1999 Hideno et al.
5,900,833 A 5/1999 Sunlin et al.
5,939,912 A 8/1999 Rehm
5,969,667 A 10/1999 Farmer et al.
5,986,600 A 11/1999 McEwan
6,002,723 A 12/1999 Chethik
6,055,287 A 4/2000 McEwan
6,137,433 A 10/2000 Zavorotny et al.
6,150,863 A 11/2000 Conn et al.
6,211,814 B1 4/2001 Benjamin et al.
6,239,764 B1 * 5/2001 Timofeev et al. ..... 343/795
6,249,242 B1 * 6/2001 Sekine et al. ..... 342/70
6,281,833 B1 8/2001 Pringle et al.
6,329,929 B1 12/2001 Weijand et al.
6,342,866 B1 * 1/2002 Ho et al. ..... 343/795
6,345,099 B1 2/2002 Alvarez
6,433,720 B1 8/2002 Libove et al.
6,501,413 B2 12/2002 Annan et al.
6,538,614 B2 3/2003 Fleming et al.
6,580,304 B1 6/2003 Rieven
6,650,661 B1 11/2003 Buchanan et al.
6,657,577 B1 * 12/2003 Gregersen et al. ..... 342/22
6,680,634 B1 1/2004 Ruha et al.
6,690,741 B1 2/2004 Larrick, Jr. et al.
6,694,273 B2 2/2004 Kurooka et al.
6,726,146 B2 4/2004 Li et al.
6,778,000 B2 8/2004 Lee et al.
6,798,258 B2 9/2004 Rieven
6,836,239 B2 12/2004 Scott
6,845,458 B2 1/2005 Lin
6,845,459 B2 1/2005 Lin
6,853,227 B2 2/2005 Laletin
6,853,338 B2 * 2/2005 McConnell ..... 343/702
6,864,833 B2 3/2005 Lyon
6,868,504 B1 3/2005 Lin
6,885,343 B2 * 4/2005 Roper ..... 343/700 MS
6,912,666 B2 6/2005 Lin
6,914,468 B2 7/2005 Van Dijk et al.
6,930,528 B2 8/2005 Ajit
6,956,422 B2 10/2005 Reilly et al.
7,020,794 B2 3/2006 Lin
7,026,850 B2 4/2006 Atyunin et al.
7,026,979 B2 4/2006 Khosla
7,037,266 B2 5/2006 Ferek-Petric et al.
7,042,385 B1 5/2006 Wichmann
7,053,814 B2 5/2006 Yap
7,157,952 B2 1/2007 Avants et al.
7,161,531 B1 1/2007 Beazell
7,203,600 B2 4/2007 Keers et al.
2002/0000946 A1 * 1/2002 Portin ..... 343/795
2003/0043078 A1 * 3/2003 Deng et al. ..... 343/700 MS
2003/0179025 A1 9/2003 Partsch et al.
2004/0036655 A1 * 2/2004 Sainati et al. ..... 343/702
2004/0090373 A1 * 5/2004 Faraone et al. ..... 343/700 MS
2004/0111650 A1 6/2004 Chen
2004/0178838 A1 9/2004 Ngo et al.
2005/0200549 A1 * 9/2005 Thompson et al. ..... 343/795
2005/0237260 A1 * 10/2005 Bancroft ..... 343/859
2005/0286320 A1 12/2005 Iwasaki
2006/0038598 A1 2/2006 Reilly et al.
2006/0038599 A1 2/2006 Avants et al.
2006/0087471 A1 4/2006 Hintz
2006/0119407 A1 6/2006 Abrosimov
2006/0132210 A1 6/2006 Kong et al.
2006/0203613 A1 9/2006 Thomsen et al.
2006/0256025 A1 * 11/2006 Askildsen et al. ..... 343/807
2007/0080864 A1 * 4/2007 Channabasappa .... 343/700 MS
2008/0001808 A1 1/2008 Passarelli et al.

FOREIGN PATENT DOCUMENTS

EP 615137 A2 9/1994

OTHER PUBLICATIONS

Montoya et al., Land Mine Detection Using a Ground-Penetrating Radar Based on Resistively Loaded Vee Dipoles, Dec. 1999, pp. 1795-1806, vol. 47, No. 12, IEEE Transactions on Antennas and Propagation.
Whitelely, et al., 50 GHz Sampler Hybrid Utilizing a Small Shockline and an Internal SRD, 1991, pp. 895-898, IEEE Microwave Theory & Technique-S Digest.
Tek Sampling Oscilloscopes Technique Primer 47W-7209, Oct. 1989, pp. 1-4, Tektronix, Inc.
Office Action issued in U.S. Appl. No. 11/754,136 mailed Jan. 5, 2009.
Office Action issued in U.S. Appl. No. 11/292,433 mailed Nov. 24, 2008.
Daniels, Jeffrey J. et al., "Ground Penetrating Radar for Imaging Archeological Objects," Proceedings of the New Millennium International Forum on Conservation of Cultural Property, Dec. 5-8, 2000, pp. 247-265, edited by Suckwon Choi and Mancheol Suh, Institute of Conservation Science for Cultural Heritage, Kongju National University, Kongju, Korea.
Kinlaw, Alton E., et al., "Use of Ground Penetrating Radar to Image Burrows of the Gopher Tortoise (*Gopherus polyphemus*)," Herpetological Review, 2007, pp. 50-56, vol. 38, No. 1, Society for the Study of Amphibians and Reptiles.
"Energy Focusing Ground Penetrating Radar (EFGPR) Overview," Jan. 28, 2003, pp. 1-12, Geo-Centers, Inc.
Wikipedia, the free encyclopedia, "Field-Programmable Gate Array," Internet Brief, "http://en.wikipedia.org/wiki/FPGA," search date Sep. 27, 2006, 7 pgs.
Office Action issued in related U.S. Appl. No. 11/754,136 mailed May 12, 2008.
Office Action issued in U.S. Appl. No. 11/754,152 mailed Oct. 21, 2008.
International Search Report issued in Application No. PCT/US08/072303 mailed Oct. 22, 2008.
Written Opinion issued in Application No. PCT/US08/072303 mailed Oct. 22, 2008.
International Search Report issued in Application No. PCT/US08/064541 mailed Nov. 4, 2008.
Written Opinion issued in Application No. PCT/US08/064541 mialed Nov. 4, 2008.
International Search Report issued in Application No. PCT/US08/072543 mailed Nov. 4, 2008.
Written Opinion issued in Application No. PCT/US08/072543 mailed Nov. 4, 2008.
Office Action issued in U.S. Appl. No. 11/754,127 mailed Feb. 26, 2009.
Office Action issued in U.S. Appl. No. 09/273,461 mailed Jan. 21, 2000.
Office Action issued in U.S. Appl. No. 09/273,461 mailed Jul. 6, 2000.
U.S. Appl. No. 09/273,461, filed Mar. 22, 1999.
Apr. 20, 2000 Response to Office Action issued Jan. 21, 2000.
Final Office Action issue in U.S. Appl. No. 11/754,152 mailed Apr. 24, 2009.
Final Office Action issue in U.S. Appl. No. 11/292,433 mailed May 12, 2009.
Response to Office Action issued in U.S. Appl. No. 11/292,433 filed Jun. 26, 2009.
Kim et al., "A Resistive Linear Antenna for Ground-Penetrating Radars", 2004, pp. 359-370, vol. 5415, proceedings of SPIE.
Kim et al., "Design of a Resistively Loaded Vee Dipole for Ultrawide-Band Ground-Penetrating Radar Applications", Aug. 2005, pp. 2525-2532, vol. 53, No. 8, IEE Transactions on Antennas and Propagation.
Kim et al., "Design and Realization of a Discretely Loaded Resistive Vee Dipole for Ground-Penetrating Radars,", Jul. 2004, pp. 1-9, vol. 39, Radio Science.

Montoya, Thomas P., "Vee Dipole Antennas for use in Short-Pulse Ground-Penetrating Radars", Mar. 1998, Georgia Institute of Technology.
Notice of Allowance issued in U.S. Appl 11/754,152 on Sep. 21, 2009.
Notice of Allowance issued in U.S. Appl 11/754,127 on Sep. 29, 2009
Request for Continued Examination (RCE) filed in related U.S. Appl. No. 11/292,433 on Nov. 10, 2009.
Notice of Allowance issued in U.S. Appl. No. 11/852,030 on Dec. 4, 2009.

* cited by examiner

METHOD AND APPARATUS FOR TRANSMITTING AND RECEIVING TIME-DOMAIN RADAR SIGNALS

BACKGROUND OF THE INVENTION

Radar systems are widely used to detect objects and to measure relative distances and speeds. Better, faster, smaller, lighter, more accurate, reliable and rugged radar systems are needed.

SUMMARY OF THE INVENTION

According to an embodiment of the invention, a radar system comprises a radar transmitter, radar receiver or radar transceiver circuit on a printed circuit board. An antenna is also on the printed circuit board and connected to the circuit on the printed circuit board. Power, trigger or data feed-lines are connected to the circuit. The antenna comprises vee dipole antenna arms on the printed circuit board. The vee dipole antenna arms further comprise plural spaced copper pads on the printed circuit board and discreet surface mount resistors connected between the copper pads.

DETAILED DESCRIPTION OF THE PREFERRED EMBODIMENTS

Figure 1:
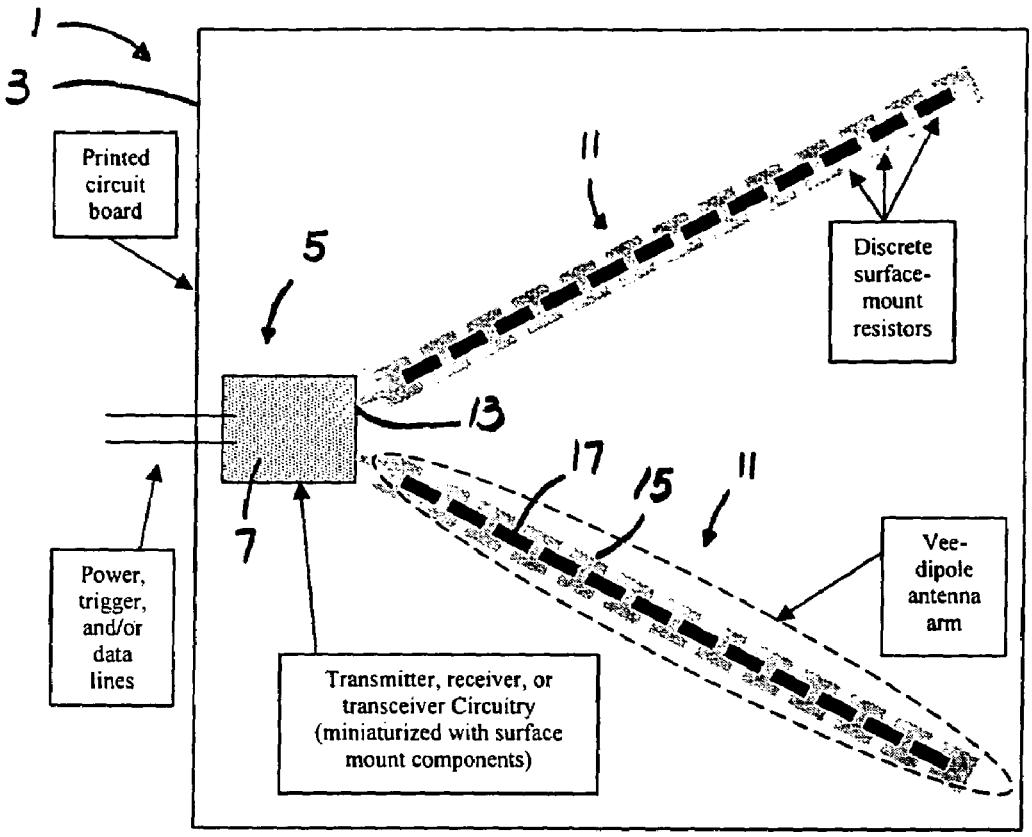
FIG. 1 schematically shows feed-point circuitry and discrete resistively loaded antenna arms on a printed circuit board.

FIG. 1 schematically shows feed-point circuitry and discrete resistively loaded antenna arms printed on a circuit board.

Apparatus for generating, transmitting, receiving and detecting radar signals, particularly for the purpose of time-domain microwave radar systems, are generally indicated by the numeral 1.

A printed circuit board 3 has a miniaturized time-domain impulse radar channel 5 containing a transmitter circuit or a receiver circuit or a miniaturized transceiver circuit 7 with surface mount components. Radiating and receiving antennas 11 transmit or receive the radar signals. Antenna 11 is fabricated on the printed circuit board 3. The time-domain impulse radar channel 5 with the receiver circuit or the transmitter circuit or transceiver circuit is included on the same printed circuit board 3, located in close proximity to the feed-point 13 of the antenna 11. A preferred antenna 11 is a resistive vee dipole having discrete resistors 17 soldered to spaced copper pads 15 deposited on the printed circuit board 3. The entire length of the antenna 11 radiates and receives signals. The resistors 17 between the copper pads 15 make the short antenna 11 operate as a long, resistive dipole antenna.

The invention is applicable to any type of antenna geometry or resistive loading. The invention is most effective with a vee-dipole geometry used with a tapered (linear or exponential) resistive profile. That minimizes antenna resonances, which cause unwanted reflections and clutter in the transmitted or received radar impulses.

The invention eliminates the need for a transmission line which would be carrying high-frequency, high-bandwidth signals between the antennas and the pulse generator or receiving circuitry. That results in fewer artifacts due to reflections in the transmission line, lower noise, and more controlled and repeatable signals. By locating all microwave signals, including the antennas 11, on a single printed circuit board 3, the signal properties can be much better controlled. Feed-lines 19 are connected to the circuit 7 for conducting power, triggers, and/or data.

Circuit boards 3 of the invention can be stacked to create an array of radar channels. The invention can be realized on a thin substrate, including but not limited to film, polycarbonate, or thin FR4 to minimize radar cross section and the effects of dispersion. FR4 is a substrate typically used for ruggedized printed circuits and has a polymeric fiberglass and epoxy structure. The printed circuit boards 3 can be fabricated with specific outlines to minimize radar cross sections in both the traveling wave direction and the orthogonal directions.

Figure 2:
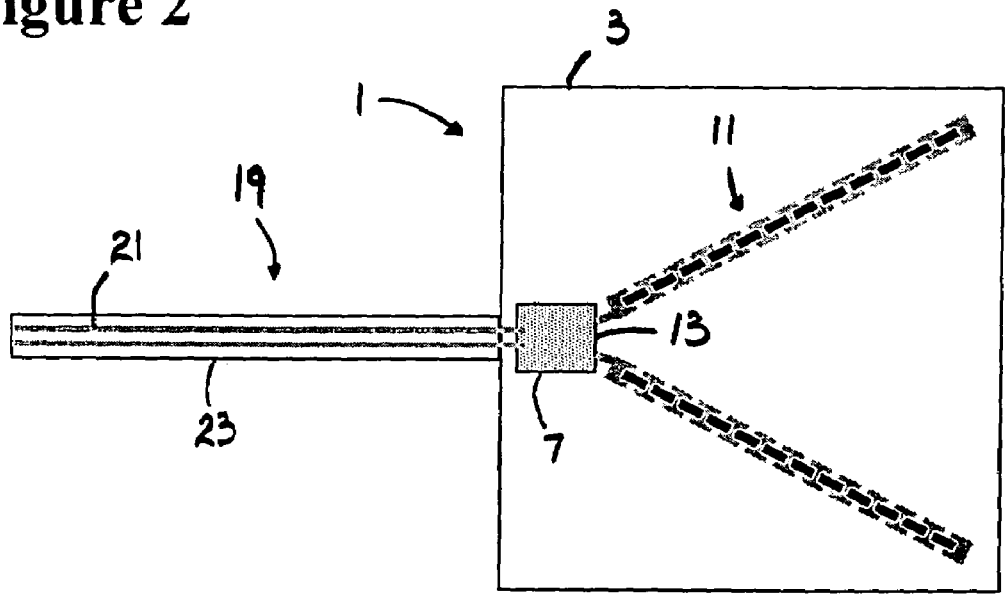
FIG. 2 schematically shows feed-point electronics driven by feed-lines which are traces printed on a long connecting circuit board.

FIG. 2 schematically shows feed-point electronics 1 driven by feed-lines 19 which are printed traces 21 on a long connecting circuit board.

Figure 3:
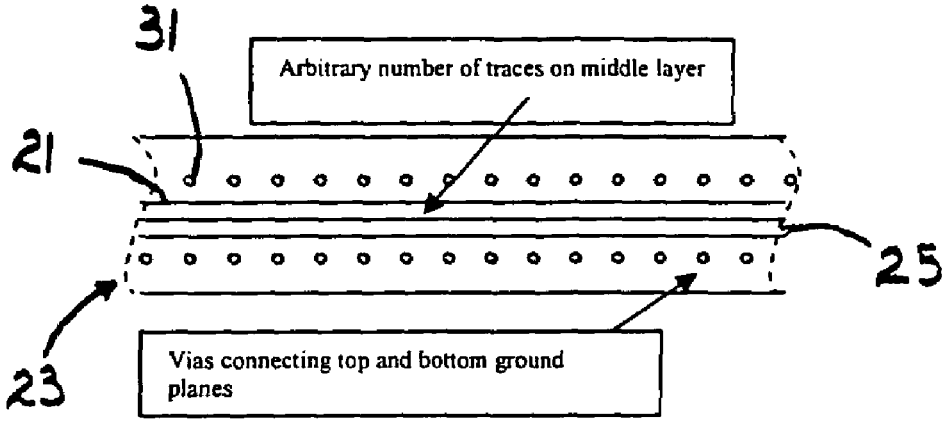
FIG. 3 is a detail view of a feed-line circuit board.

FIG. 3 is a detail view of feed-lines 21 on a circuit board 23 which is a middle layer between two ground layers.

Connections to the printed circuit board 3 are provided via traces 21 printed on a long strip 23 of circuit board material. Circuit board strip 23 can be made of the same material as circuit board 3. In one embodiment, the strip 23 of the circuit board is an extension of the same circuit board 3 which mounts the transceiver 7 and antenna assembly 11. That is desirable, as it allows the system electronics (not shown) to be located at a distance from the feed-point 13 of the antenna 11. The electronics could be located behind radar absorbing material or far enough away as to place them outside the range gate of the receiver. By fabricating the feed-lines as traces 21 on a printed circuit board 23, the impedance can be very carefully controlled along the length of the feed-line traces 21, reducing clutter-causing reflections in the received signal. It is also cheaper and easier to manufacture than using conventional feed-lines, such as co-axial cables.

In a preferred embodiment, as shown in the FIG. 3 detail, feed-line traces 21 are formed in an insulator layer 25 are sandwiched between two thin, parallel conductive layers or ground planes which are connected to each other by through vias 31 at periodic intervals.

The invention provides the inclusion of the transmitter or receiver circuitry 7 on the same printed circuit board 3 as the antennas 11. The invention results in radar signals that have fewer reflection artifacts, lower noise, and is more reliably and less expensively manufactured than the prior art.

Figure 4:
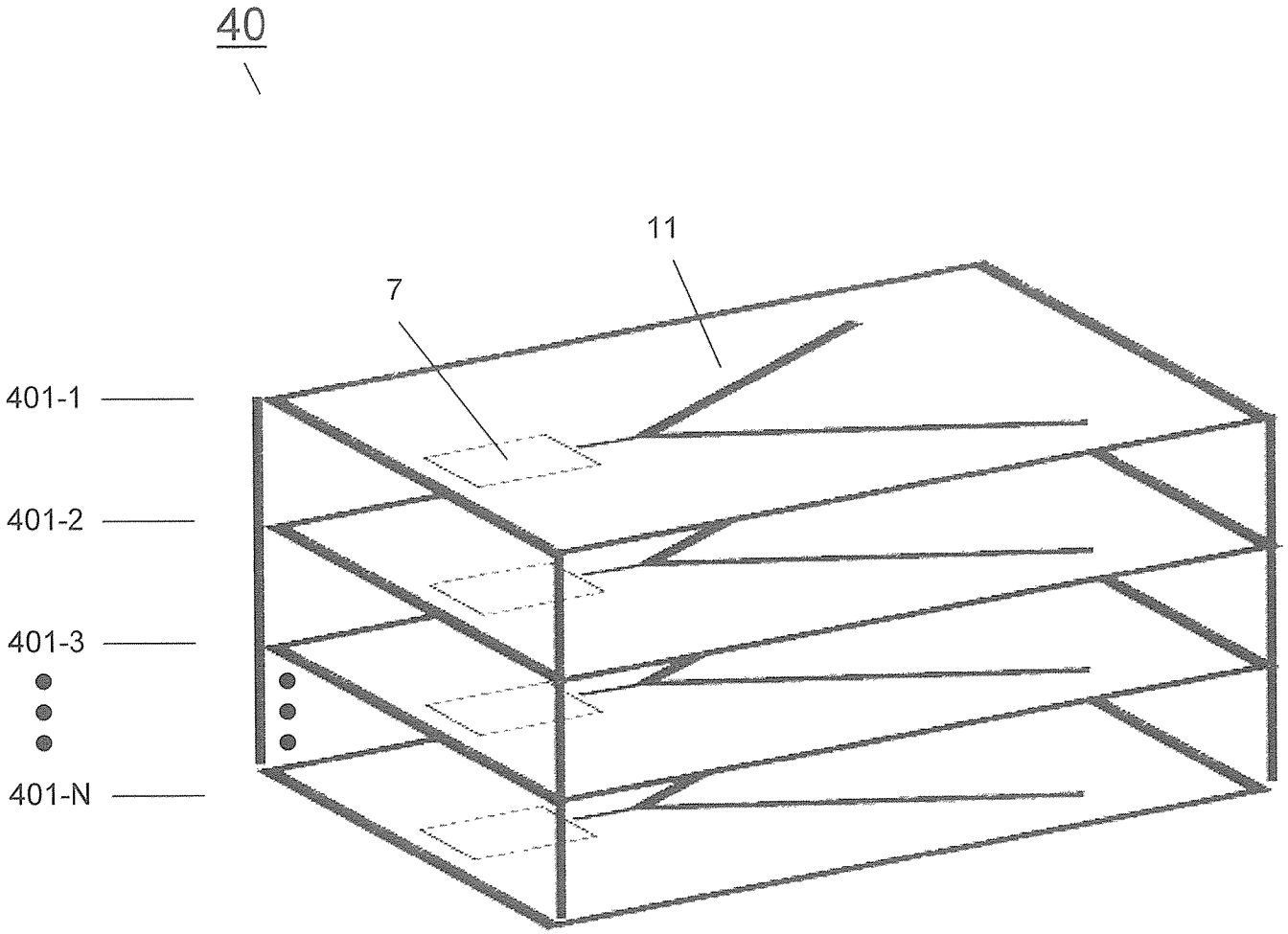
FIG. 4 schematically shows printed circuit boards configured according to one embodiment of the present invention stacked to create an array of radar channels.

FIG. 4 schematically shows printed circuit boards configured according to one embodiment of the present invention stacked to create an array of radar channels. Array 40 comprises circuit boards 401-1-401-N. Each of printed circuit boards 401-1-401-N includes miniaturized transceiver circuit 7 and antenna 11. By stacking circuit boards 401-1-401-N, array 40 is created having multiple radar channels.

While the invention has been described with reference to specific embodiments, modifications and variations of the invention may be constructed without departing from the scope of the invention, which is defined in the following claims.

The invention claimed is:

1. A radar system, comprising a printed circuit board, a radar transmitter, radar receiver or radar transceiver circuit on the board, an antenna on the printed circuit board and connected to the circuit on the printed circuit board with no transmission lines between the antenna and the circuit, and power, trigger or data feed-lines connected to the circuit, wherein the antenna comprises vee dipole antenna arms on the printed circuit board, and wherein the vee dipole antenna arms further comprise plural spaced copper pads on the printed circuit board and discreet surface mount resistors connected between the copper pads.

2. The radar system of claim 1, wherein the copper pads are deposited on the circuit board and the discrete surface mount resistors are soldered to the deposited copper pads.

3. The radar system of claim 1, wherein the feed-lines further comprise a connecting circuit board having a middle layer and top and bottom ground layers, plural circuit traces on the middle layer, and plural vias connecting the top and bottom ground layers.

4. The radar system of claim 1, wherein only the radar transmitter, radar receiver or radar transceiver circuit and the antenna are co-located on the printed circuit board.

5. The radar system of claim 3, wherein a width of the radar transmitter, radar receiver or radar transceiver circuit is substantially less than a width of the antenna.

6. A radar system comprising a printed circuit board and an antenna system deposited on the printed circuit board, the antenna system having at least one feed-point deposited on the printed circuit board, a radar transmitter, radar receiver or radar transceiver circuit on the printed circuit board and connected at the least one feed-point on the printed circuit board, wherein the antenna comprises vee dipole antenna arms on the printed circuit board, and wherein the vee dipole antenna arms further comprise plural spaced copper pads on the printed circuit board and discreet surface mount resistors connected between the copper pads.

7. The radar system of claim 6, wherein the copper pads are deposited on the circuit board and the discreet surface mount resistors are soldered to the deposited copper pads.

8. The radar system of claim 6, further comprising feed-lines connected to the circuit on the printed circuit board.

9. The radar system of claim 8, wherein the feed-lines further comprise a connecting circuit board having a middle layer and top and bottom ground layers, plural circuit traces on the middle layer, and plural vias connecting the top and bottom ground layers.

10. The radar system of claim 6, wherein a width of the radar transmitter, radar receiver or radar transceiver circuit is substantially less than a width of the antenna.

11. A radar system method comprising providing a printed circuit board, providing a radar circuit including a radar transmitter, a radar receiver, or radar transceiver on the printed circuit board, providing an antenna on the printed circuit board, providing a feed-point connecting the antenna and the radar circuit with no transmission lines between the antenna and the radar circuit, and providing power to the circuit, wherein the providing the antenna comprises providing vee dipole antenna arms on the printed circuit board, and wherein the providing vee dipole antenna arms further comprise providing plural spaced copper pads on the printed circuit boards, providing discrete surface mount resistors between the copper pads, and connecting the discrete surface mount resistors to the copper pads.

12. The radar system method of claim 11, further comprising sending and receiving radar pulses form the antenna on the printed circuit board and providing outputs form the radar circuit on the printed circuit board through feed-lines.

13. The radar system method of claim 11, wherein the providing the copper pads comprises depositing the copper pads on the printed circuit board, and wherein the connecting the discrete surface mount resistor comprises soldering the resistors to the deposited copper pads.

14. The radar system method of claim 11, further comprising providing feed-lines and connecting the feed-lines to the circuit on the printed circuit board.

15. The radar system method of claim 11, wherein the providing the feed-lines further comprises providing a connecting circuit board having a middle layer and top and bottom ground layers, providing plural circuit trances on the middle layer, providing plural vias and connecting the top and bottom ground layers with the plural vias.

16. A radar system, comprising:

a printed circuit board;

a radar transmitter, radar receiver or radar transceiver circuit on the board;

an antenna on the printed circuit board and connected at the circuit on the printed circuit board; and power, trigger or data feed-lines connected to the circuit, wherein the antenna comprises a dipole antenna on the printed circuit board and wherein the dipole antenna further comprises plural spaced conductive pads on the printed circuit board and resistors connected between the conductive pads.

17. A radar system method comprising:

fabricating a plurality of circuit boards, each of said circuit boards, fabricated as follows:

disposing a radar circuit including a radar transmitter, a radar receiver, or radar transceiver on a printed circuit board;

disposing an antenna on the printed circuit board, including disposing plural spaced conductive pads on the printed circuit board and disposing resistors between the copper pads; and disposing a feed-point connecting the antenna and the radar circuit such that there are no transmission lines between the antenna and the radar circuit; and stacking said plurality of printed circuit boards to create an array of radar channels.

* * * * *